US009046069B2

(12) United States Patent
Nagy

(10) Patent No.: US 9,046,069 B2
(45) Date of Patent: Jun. 2, 2015

(54) STARTER MOTOR WITH TORQUE LIMITER

(75) Inventor: Attila Nagy, Fishers, IN (US)

(73) Assignee: Remy Technologies, LLC

( * ) Notice: Subject to any disclaimer, the term of this patent is extended or adjusted under 35 U.S.C. 154(b) by 766 days.

(21) Appl. No.: 13/312,008

(22) Filed: Dec. 6, 2011

(65) Prior Publication Data

US 2013/0139645 A1 Jun. 6, 2013

(51) Int. Cl.
*F02N 15/04* (2006.01)
*F02N 15/02* (2006.01)

(52) U.S. Cl.
CPC ..... *F02N 15/02* (2013.01); *Y10T 74/137* (2015.01); *F02N 15/046* (2013.01)

(58) Field of Classification Search
None
See application file for complete search history.

(56) References Cited

U.S. PATENT DOCUMENTS

| | | | |
|---|---|---|---|
| 7,451,668 | B2 | 11/2008 | Hasegawa et al. |
| 2008/0276734 | A1 | 11/2008 | Fulton |
| 2009/0320644 | A1 | 12/2009 | Farrar et al. |

*Primary Examiner* — Erin D Bishop
(74) *Attorney, Agent, or Firm* — Maginot Moore & Beck

(57) ABSTRACT

A starter motor includes a housing, a planetary gear assembly, and a plurality of detents. The housing defines an interior space. The planetary gear assembly is at least partially positioned in the interior space and includes a plurality of planetary gear components. The planetary gear components include a sun gear, an annulus, a plurality of planet gears, and a planetary gear carrier. The plurality of detents is configured to releasably retain a rotational position of a component of the planetary gear components relative to the housing. Each of the detents includes a biasing member and a bearing member.

20 Claims, 5 Drawing Sheets

STARTER MOTOR WITH TORQUE LIMITER

FIELD

The present disclosure relates generally to a starter motor for starting an internal combustion engine and particularly to a starter motor including a torque limiter.

BACKGROUND

Most automotive and heavy-duty vehicles use engine starter motors with internal gear trains. The internal gear trains are typically planetary configurations. Planetary gearing is a gear system that consists of an outer gear referred to as an annulus, one or more planet gears, and a central gear referred to as a sun gear. Typically, the planet gears are mounted on a planetary gear carrier and are configured to rotate around the sun gear. The planet gears are meshingly engaged with a geared opening of the annulus. The annulus is typically held in a stationary position within a housing of the starter motor.

The gear train transfers rotation of an electric motor of the starter motor to an overrun clutch of the starter motor and then to a pinion gear of the starter motor. In particular, an input of the gear train, which is typically the sun gear, is connected to an output shaft of the electric motor. An output of the gear train, which is typically the planetary gear carrier, is connected to an input of the overrun clutch. An output of the overrun clutch is connected to the pinion gear. Rotation of the output shaft of the electric motor results in rotation of the sun gear. The rotating sun gear causes the planet gears and the planetary gear carrier to rotate. The overrun clutch transfers rotation of the plenary gear carrier to the pinion gear. The pinion gear is slidably mounted on a pinion shaft, and is movable between an engaged position and a disengaged position.

To start an engine with the typical starter motor, the pinion gear is moved to the engaged position, in which the pinion gear becomes meshingly engaged with a geared portion of a flywheel of the engine. Next or at the same time, the electric motor is activated, which causes the pinion gear and the flywheel to rotate. The rotating flywheel puts the engine pistons into motion, which typically causes the engine to start. When the engine does start, the flywheel begins to rotate at a rotational rate that is greater than the rotational rate of the pinion gear, which causes the overrun clutch to decouple the pinion gear from the output of the gear train. This prevents damage to the gear train, which may occur as a result of the rapidly rotating flywheel. The pinion gear is moved to the disengaged position after the engine is started.

When the pinion gear is engaged with the flywheel and is rotating the flywheel, the engine loads the starter motor with a pulsating torque that is a result of the pistons moving within the engine cylinders, among other moving engine parts. The pulsating torque is typically less than the stall torque, a term that refers to the magnitude of torque that causes the output shaft of the electric motor to stop rotating. The engine, however, may load the starter motor with a torque that is much greater in magnitude than the stall torque during certain engine events. These engine events may include engine backfire, hydraulic lock-up, or engagement of the pinion gear with the flywheel after the engine is already started. For example, hydraulic lock-up may result in a torque that is about five hundred percent (500%) to six hundred percent (600%) of the stall torque. The high torque is primarily caused by kinetic energy stored in the output shaft of the electric motor, which is then converted to strain energy upon rapid deceleration of the output shaft.

Vehicle manufacturers require that the starter motor should not fail or cause failure of other engine components as a result of the high-torque engine events described above. To meet this requirement, starter motor manufacturers design starter motor components to withstand a torque in excess of the stall torque. This often results in starter motor components being larger, heavier, or made from more robust and expensive materials than if the components were only required to withstand the torque encountered during normal engine operation.

Therefore, it is desirable to provide a starter motor that limits the torque internal to the starter motor so that the starter motor can be smaller, lighter, and less expensive to manufacture.

SUMMARY

According to one embodiment of the present disclosure, a starter motor includes a housing, a planetary gear assembly, and a plurality of detents. The housing defines an interior space. The planetary gear assembly is at least partially positioned in the interior space and includes a plurality of planetary gear components. The planetary gear components comprise a sun gear, an annulus, a plurality of planet gears, and a planetary gear carrier. The plurality of detents is configured to releasably retain a rotational position of a component of the planetary gear components relative to the housing. Each of the detents including a biasing member and a bearing member.

According to another embodiment of the present disclosure, a starter motor includes a housing and a planetary gear assembly. The housing defines an interior space. The planetary gear assembly is at least partially positioned in the interior space. The planetary gear assembly includes a plurality of planetary gear components. A component of the planetary gear components is configured to remain stationary relative to the housing when a component torque is less than a predetermined torque level. The component of the planetary gear components is configured to rotate relative to the housing when the component torque is greater than or equal to the predetermined torque level.

According to yet another embodiment of the present disclosure, a starter motor includes a housing, a planetary gear assembly, a plurality of biasing members, and a plurality of bearing balls. The housing defines an interior space and a plurality of bores. The planetary gear assembly is at least partially positioned in the interior space and includes a sun gear, an annulus defining a plurality of grooves, and a plurality of planet gears. Each of the biasing members is at least partially positioned in a respective one of the bores. The plurality of bearing balls are movable between a first position and a second position. Each of the bearing balls are biased toward the annulus by a respective one of the biasing members. In the first position the biasing members bias each of the bearing balls at least partially into a respective one of the grooves to prevent rotation of the annulus relative to the housing. In the second position the plurality of bearing balls are displaced from the plurality of grooves to enable rotation of the annulus relative to the housing.

BRIEF DESCRIPTION OF THE FIGURES

The above-described features and advantages, as well as others, should become more readily apparent to those of ordinary skill in the art by reference to the following detailed description and the accompanying figures in which.

DETAILED DESCRIPTION

Figure 1:
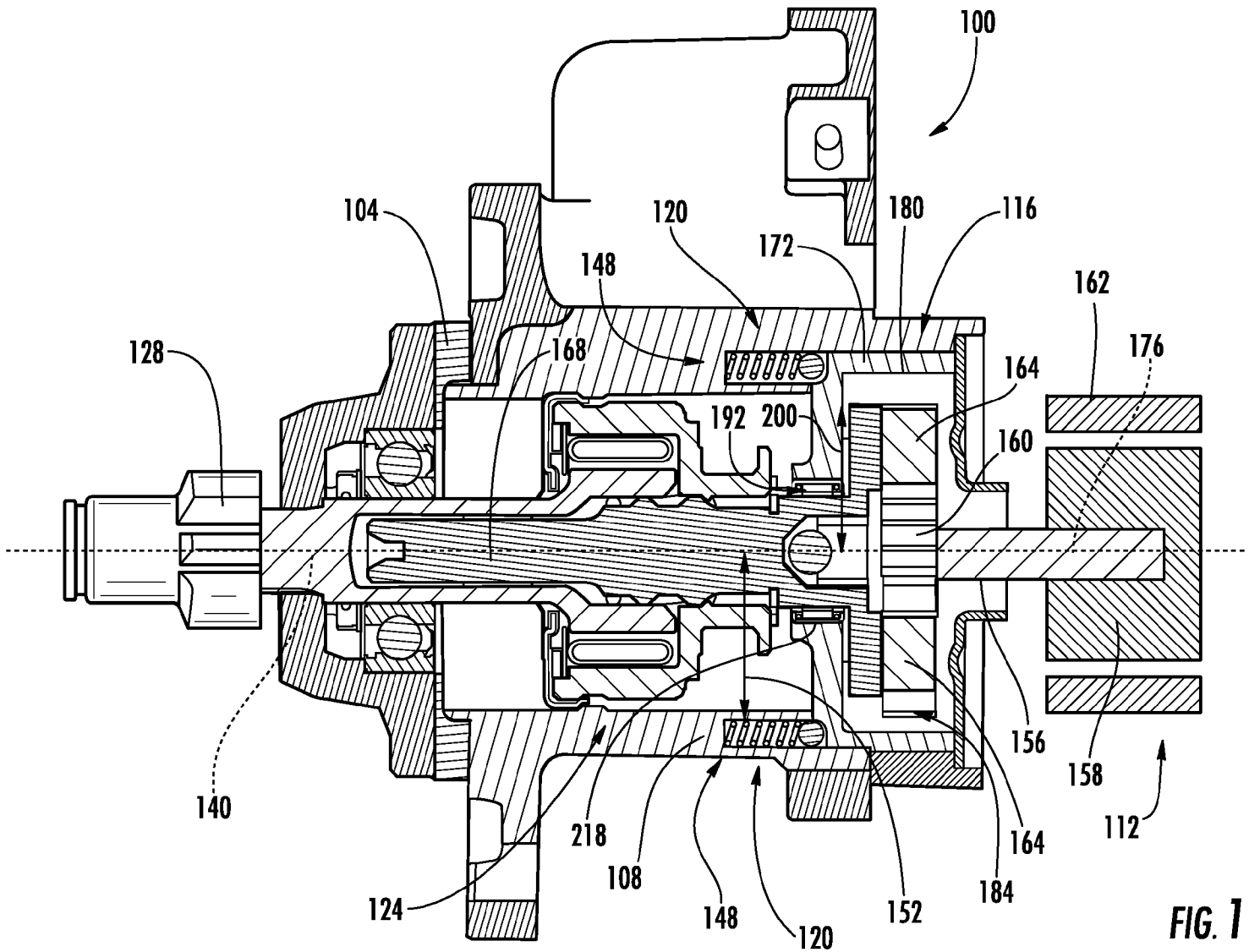
FIG. 1 is a cross sectional view of a portion of a starter motor according to one embodiment of the present disclosure.

For the purpose of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles of the disclosure as would normally occur to one skilled in the art to which this disclosure pertains.

As shown in FIG. 1, a starter motor 100 includes a housing 104, a bore structure 108, an electric motor 112, a planetary gear assembly 116, numerous detents 120, an overrun clutch assembly 124, and a pinion gear 128. As will be explained in further detail below, the detents 120 releasably retain a component of the planetary gear assembly 116 (the annulus 172, as shown in the embodiment of FIG. 1) in a stationary position relative to the housing 104 when a torque exerted on the component is below a torque level that may damage the starter motor 100. The detents 120 enable rotation of the component of the planetary gear assembly 116 relative to the housing 104 when the torque exerted on the component is greater than or equal to a torque level that may damage the starter motor 100.

Figure 2:
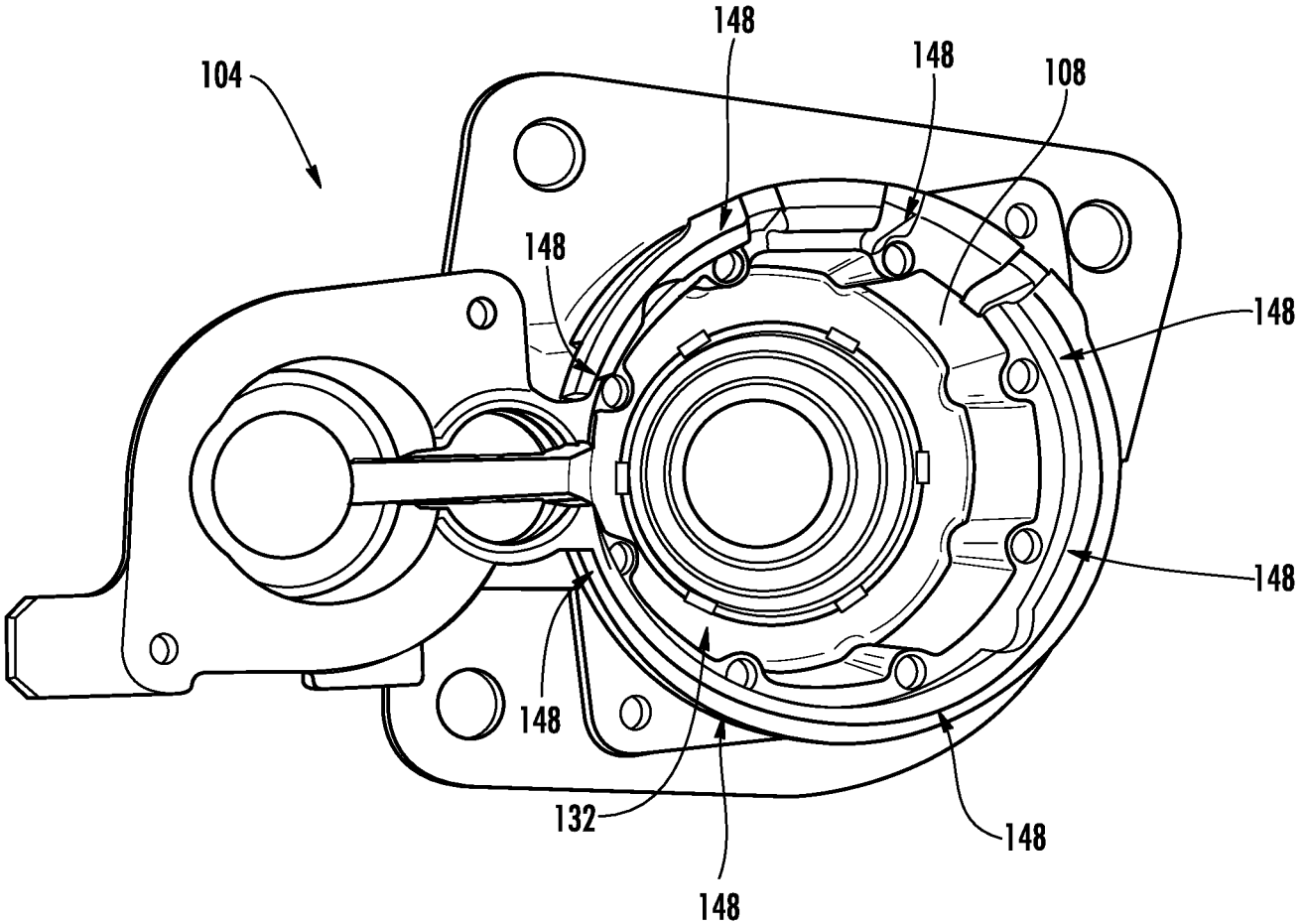
FIG. 2 is a perspective view of a housing of the starter motor of FIG. 1.

As shown in FIG. 2, the housing 104 defines an interior space 132. The interior space 132 is generally cylindrical and defines a longitudinal axis 140 (FIG. 1) that extends through the interior space. The housing 104 is made of metal, such as steel, aluminum, or other another suitable material as known to those of ordinary skill in the art.

The bore structure 108 is provided on the housing 104 and is positioned within the interior space 132. In particular, in the embodiment of FIG. 2, the bore structure 108 is integrally formed with the housing 104, such that the bore structure and the housing are a monolithic part.

With continued reference to FIG. 2, the bore structure 108 defines a plurality of bores 148 positioned within the interior space 132. The bores 148 are cavities having a generally cylindrical shape. Each of the bores 148 is positioned a fixed radial distance 152 (see FIG. 1) from the longitudinal axis 140. In the disclosed embodiment, the bores 148 have a length between two and five centimeters (2-5 cm) and a diameter of approximately one-quarter to two centimeters (0.25-2 cm). The bore structure 108 defines eight (8) of the bores 148. In another embodiment of the starter motor 100, the bore structure 108 may define between four (4) and twelve (12) of the bores 148.

With reference again to FIG. 1, the electric motor 112 (shown as a block diagram in FIG. 1) is at least partially positioned in the interior space 132 of the housing 104. The electric motor 112 is any electric motor known to those of ordinary skill in the art. The electric motor 112, includes an output shaft 156, a rotor 158, and a generally cylindrical stator 162. The output shaft 156 is connected to the rotor 158 and is supported to enable rotation of the rotor relative to the stator 162. When the electric motor 112 is supplied with electrical energy, typically from a battery (not shown), the electric motor imparts a motor torque on the output shaft 156.

The planetary gear assembly 116 is at least partially positioned in the interior space 132 defined by the housing 104. The planetary gear assembly 116 includes a plurality of planetary gear components. The planetary gear components include a sun gear 160, a plurality of planet gears 164, a planetary gear carrier 168, and an annulus 172. The planetary gear components are made of metal or another hard material such as plastic.

As shown in FIG. 1, the sun gear 160 is connected to the output shaft 156 of the electric motor 112 and rotates in response to rotation of the output shaft 156 and the rotor 158. The sun gear 160 defines an axis of rotation 176 that is coaxial with the longitudinal axis 140 defined by the housing 104.

The planet gears 164 are positioned to meshingly engage the sun gear 160. The planetary gear assembly 116 includes four (4) of the planet gears 164, although only two (2) of the planet gears are shown in FIG. 1. In other embodiments, the planetary gear assembly 116 may include three (3) to five (5) or more of the planet gears 164.

The planetary gear carrier 168 is connected to the planet gears 164. The planetary gear carrier 168 rotates about the axis of rotation 176 in response to the planet gears 164 revolving around the axis of rotation. Rotation of the planetary gear carrier 168 is coupled to the pinion gear 128 through the clutch assembly 124, in a manner known to those of ordinary skill in the art.

Figure 3:
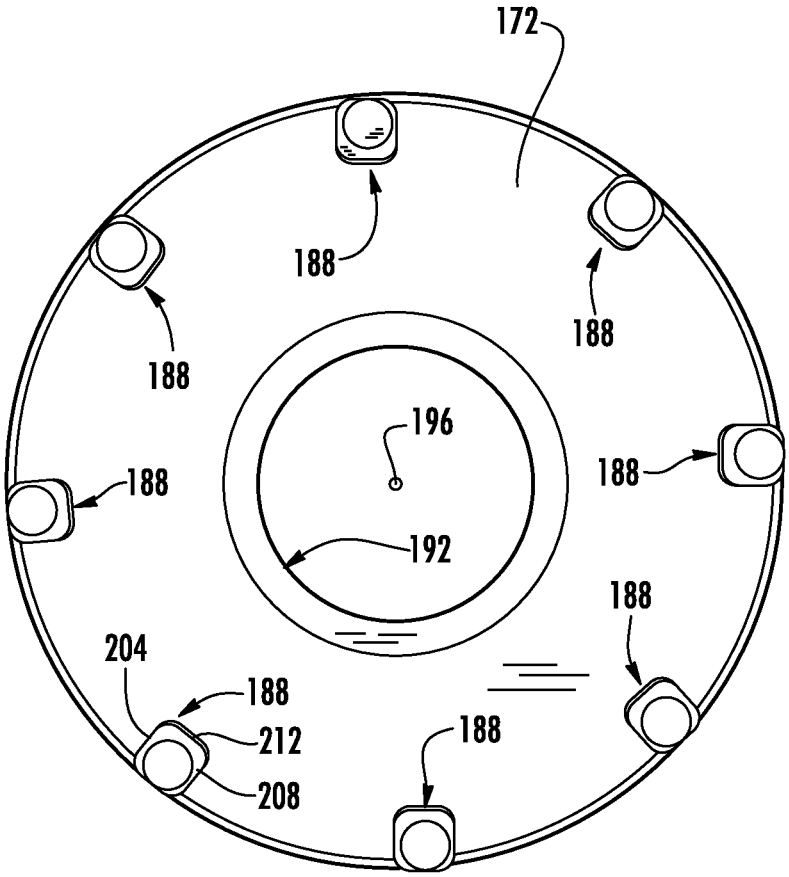
FIG. 3 is a front elevational view of an annulus of the starter motor of FIG. 1, showing a plurality of bearing members positioned in a plurality of grooves formed in the annulus.
Figure 4:
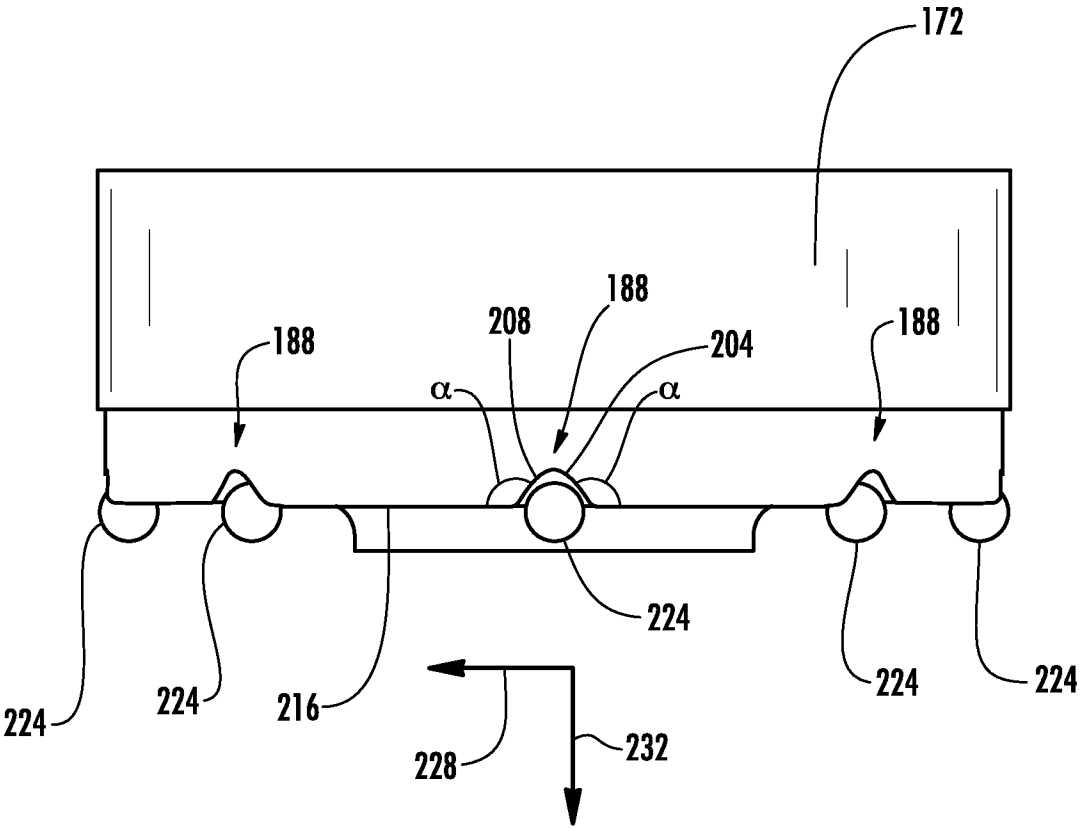
FIG. 4 is a top plan view of the annulus and the bearing members of FIG. 3.

With continued reference to FIG. 1, the annulus 172 of the planetary gear assembly 116 is a generally cup-shaped member that defines a geared surface 180, a cavity 184, and plurality of grooves 188 (FIGS. 3 and 4). Each of the planet gears 164 meshingly engages a portion of the geared surface 180. The planet gears 164 and the sun gear 160 are at least partially positioned within the cavity 184. The annulus 172 defines an opening 192 (FIGS. 1 and 3) through which the planetary gear carrier 168 extends. A center point 196 (FIG. 3) of the opening 192 is aligned with the axis of rotation 176.

As shown in FIG. 3, the grooves 188 are formed on a peripheral portion of the annulus 172. The grooves 188 are evenly spaced around the periphery of the annulus 172 and are each positioned a radial distance 200 (FIG. 1) from the axis of rotation 176. Each of the grooves 188 receives a portion of a corresponding one of the detents 120. The annulus 172 defines eight (8) of the grooves 188.

With reference to FIGS. 3 and 4, the grooves 188 are defined by a first side surface 204, a second side surface 208, and a bottom surface 212. The first side surface 204 is offset from a face 216 of the annulus 172 by an angle $\alpha$. The second side surface 208 is also offset from the face 216 by the angle $\alpha$. As shown in the embodiment of FIG. 4, the angle $\alpha$ is approximately one hundred thirty degrees (130°). In other embodiments of the annulus 172, the angle $\alpha$ may be between one hundred degrees (100°) to one hundred seventy degrees (170°). The bottom surface 212 intersects the first side surface 204 and the second side surface 208. The grooves 188 interact with the detents 120, as described below.

As shown in FIG. 1, the annulus 172 includes a bearing member 218 positioned in the opening 192. The bearing member 218, in the embodiment of FIG. 1, is a needle roller bearing; however, in other embodiments the bearing member may be provided as any type of bearing member. The bearing member 218 rotatably supports the planetary gear carrier 168 to enable rotation of the planetary gear carrier relative to the annulus 172.

Figure 5:
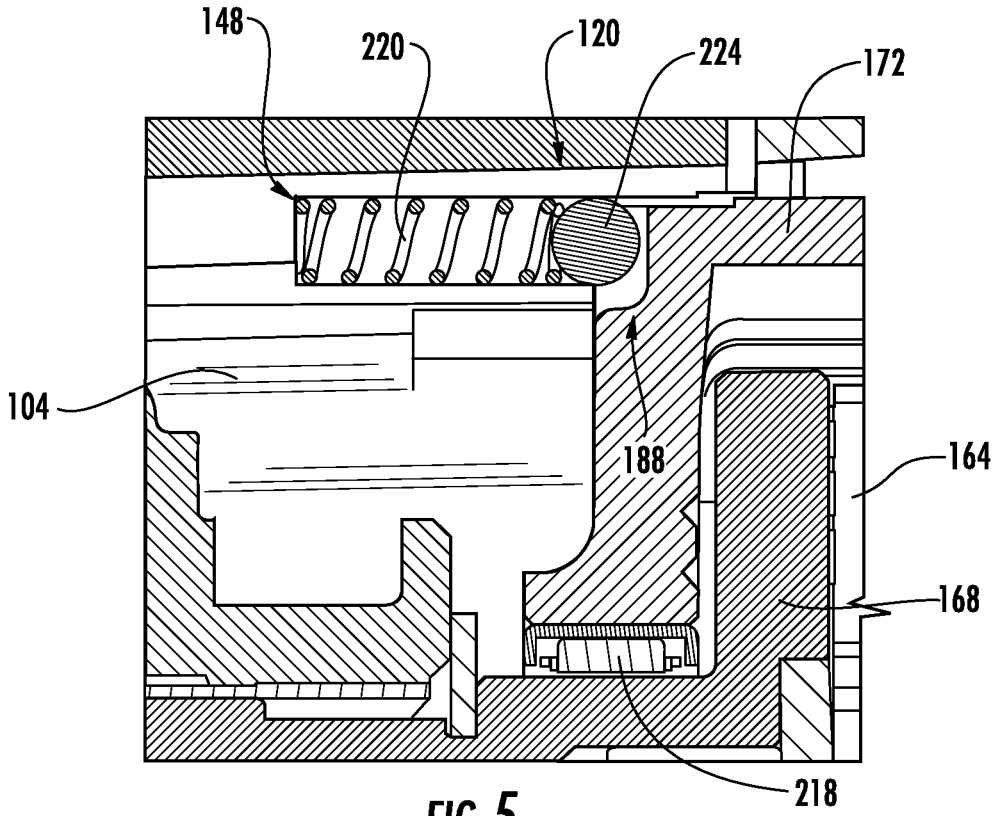
FIG. 5 is a cross sectional view of a portion of the starter motor of FIG. 1, showing one of the bearing members in an engaged position.
Figure 6:
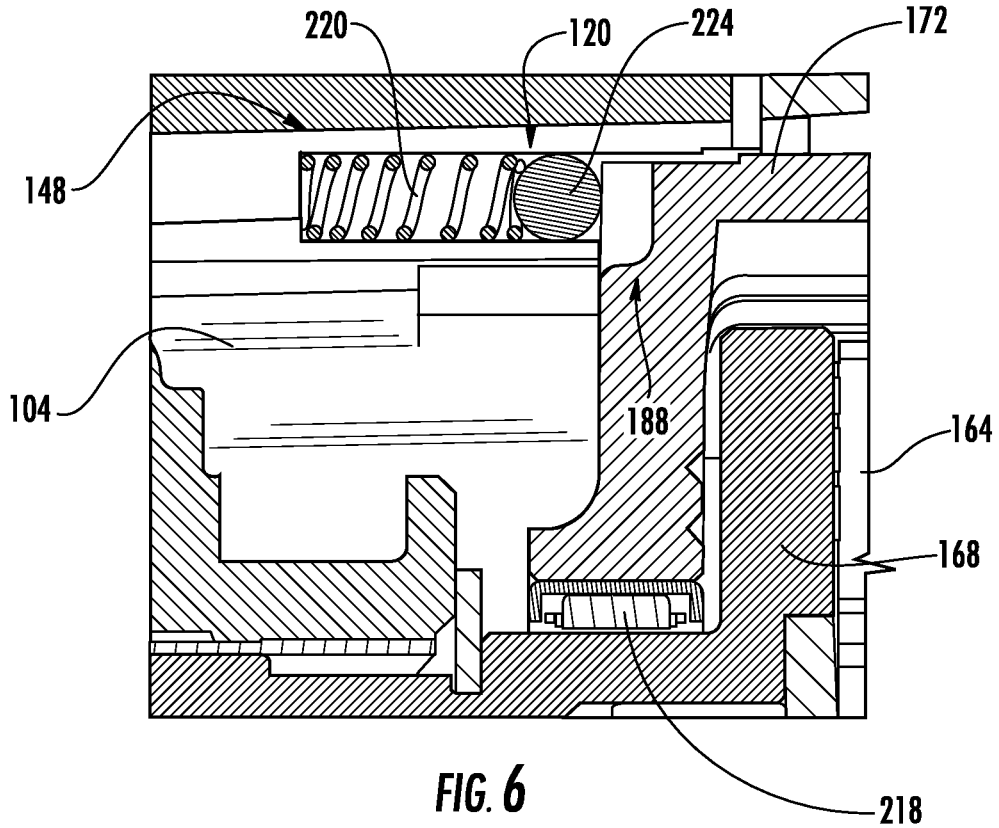
FIG. 6 is a cross sectional view of a portion of the starter motor of FIG. 1, showing one of the bearing members in a disengaged position.

As shown in FIGS. 5 and 6, the detents 120 each include a biasing member 220 and a bearing member 224. The detents 120 are evenly spaced around the periphery of the bore structure 108 and are positioned the radial distance 200 (FIG. 1) from the axis of rotation 176. Each of the biasing members 220 is at least partially positioned in a corresponding one of the bores 148. The biasing members 220 are compression springs, which generate a biasing force in a direction that is parallel to the longitudinal axis 140.

The bearing members 224 are bearing balls, which have a generally spherical shape. The bearing members 224 are biased toward the annulus 172 by the biasing members 220. The bearing members 224 are formed from steel; however, in other embodiments, the bearing members may be formed from other sufficiently hard materials. Additionally, in other embodiments, the bearing members 224 may be provided as generally cylindrical rollers (not shown).

The detents 120 are movable between an engaged position and a disengaged position. When the detents 120 are in the engaged position, the biasing members 220 bias the bearing members 224 at least partially into the grooves 188 of the annulus 172 (as shown in FIGS. 3, 4, and 5), such that the detents prevent rotation of the annulus relative to the housing 104. When the detents 120 are in the disengaged position (FIG. 6), the bearing members 224 are displaced from the grooves 188 and the annulus 172 is rotatable relative to the housing 104.

The detents 120 are positioned in the engaged position when a torque load exerted on the output shaft 156 by the electric motor (referred to herein as the motor torque or a component torque) is below a predetermined torque level, which equals approximately one hundred thirty percent (130%) to two hundred percent (200%) of the stall torque of the electric motor. Accordingly, during most engine starting operations, the detents 120 remain in the engaged position and prevent rotation of the annulus 172 relative to the housing 104, such that rotation of the sun gear 160 by the output shaft 156 results in rotation of the planetary carrier 168 and the pinion gear 128.

The detents 120 move to the disengaged position when the motor torque is greater than or equal to the predetermined torque level, as may occur during engine events such as engine backfire, hydraulic lock-up, or if the pinion gear 128 is caused to engage the flywheel when the engine is already in operation. In particular, the detents 120 move to the disengaged position when less torque is required for the electric motor 112 to move the detents to the disengaged position and rotate the annulus 172 than is required for the electric motor to rotate the planetary gear carrier 168. Accordingly, by moving to the disengaged position the detents 120 direct the motor torque from the planetary gear carrier 168 to the annulus 172 to prevent damage to the starter motor 100.

The annulus 172 causes the detents 120 to move to the disengaged position by applying a force to the detents that compresses the biasing members 220 and moves the bearing members 224 away from the grooves 188. The force applied to the detents 120 by the annulus 172 is generated by the torque applied to the annulus by the electric motor 112. The torque applied to the annulus 172 is transmitted to the detents 120 by contact between the first side surface 204 and the second side surface 208 and the bearing member 224.

As shown in FIG. 4, the force applied to the bearing member 224 by the side surface 204 has a perpendicular component 228 and a parallel component 232. The perpendicular component 228 is perpendicular to the axis of rotation 176 and generally does not contribute to moving the detents 120 to the disengaged position. The parallel component 232 is parallel to the axis of rotation 176 and, if of sufficient magnitude, moves the bearing member 224 away from the groove 188 and compresses the biasing member 220. If the bearing members 224 are sufficiently displaced from the grooves 188 (i.e. as occurs when the motor torque is equal to or exceeds the predetermined torque level), the grooves slip past the bearing members and rotation of the annulus 172 is enabled. The detents 120 return to the engaged position and stop rotation of the annulus 172 when the motor torque is less than the predetermined torque level.

The magnitude of the predetermined torque level is based on the spring constant of the biasing members 220, the angle $\alpha$, the total number of the detents 120, as well as other factors. Increasing the spring constant increases the predetermined torque level by requiring a greater magnitude of the parallel force 232 to move the bearing members 224 from the engaged position within the grooves 188. Decreasing the spring constant decreases the predetermined torque level by requiring a lesser magnitude of the parallel force 232 to move the bearing members 224 from the engaged position. Increasing the angle $\alpha$, decreases the predetermined torque level by directing a greater amount of the force applied to the bearing members 224 in the parallel direction and also causes less force to be applied in the perpendicular direction. Decreasing the angle $\alpha$, increases the predetermined torque level by directing a lesser amount of the force applied to the bearing members 224 in the parallel direction and increases the amount of force being applied in the perpendicular direction. Increasing the total number of the detents 120 generally increases the predetermined torque level, and decreasing the total number of the detents generally decreases the predetermined torque level.

As described above, the typical starter motor is designed and manufactured to withstand a motor torque of about five hundred percent (500%) to six hundred percent (600%) of the stall torque. This requires the typical motor starter to be more robust than is necessary for most engine starting operations. The starter motor 100 described herein may be manufactured less robustly (i.e. smaller and lighter) without sacrificing its ability to withstand a high motor torque. In particular, the starter motor 100 need only be designed to withstand a motor torque that is slightly greater than the predetermined torque level, since the detents 120 prevent the electric motor 112 from being subject to torque levels in excess of the predetermined torque level. Being less robust than the typical starter motor may make the starter motor 100 less expensive to manufacture.

In operation, the detents 120 prevent damage to the starter motor 100 as a result of a motor torque in excess of the predetermined torque level. During an engine starting operation the pinion gear 128 is moved into position to engage the flywheel of the engine and the output shaft 156 rotates the sun gear 160. Since the detents 120 retain the rotational position of the annulus 172, the planet gears 164 revolve around the axis of rotation 176 and the planetary gear carrier 168 rotates about the axis of rotation. Rotation of the planetary gear carrier 168 rotates the pinion 128 and the flywheel. The rotation of the flywheel puts the pistons in motion and typically starts the engine.

During the engine starting operation an engine event may occur that generates a motor torque in excess of the predetermined torque level. In a conventional starter motor, the excessive torque is transmitted to the output shaft of the electric motor and may damage the electric motor and/or another part of the conventional starter motor. The starter motor 100 as described herein, however, diverts the excessive motor torque away from the electric motor 112 to prevent damage to the electric motor and/or the other parts of the starter motor.

The starter motor 100 diverts the excessive motor torque that may be generated during an engine event according to the following. The motor torque is transmitted from the pinion gear 128, to the overrun clutch 124, and then to the planetary gear carrier 168. The excessive torque may cause the pinion gear 128 and the planetary gear carrier 168 to stop rotating at a very high rate of deceleration. The outputs shaft 156, however, tends to continue to rotate since the electric motor 112 remains supplied with electrical energy and also due to the inertia of the output shaft 156 and the rotor 158. Since the motor torque exceeds the predetermined torque level, the electric motor 122 may more easily rotate the annulus 172 than the planarity gear carrier 168. Accordingly, the torque generated by the electric motor 112 is diverted to the annulus 172, which causes rotation of the annulus and moves the detents 120 to the disengaged position. The electric motor 112 continues to rotate the annulus 172 instead of the planetary gear carrier 168 until the motor torque is less than the predetermined torque level or until the electric motor is no longer supplied with electrical energy, at which point the detents 120 return to the engaged position.

When the annulus 172 is rotated relative to the housing 104, the grooves 188 rotate past the bearing members 224 and in doing so generate sound that is audible to most users. Upon hearing the sound a user may become alerted to the engine event and in response the user may halt the supply of electrical energy to the electric motor 112.

In an alternative embodiment of the starter motor 100 the detents 120 may be configured to releasably retain another component of the planetary gear assembly 116 (i.e. the planet gears 164 or the sun gear 160). For example, in an embodiment in which the detents 120 releasably retain the rotational position of the planet gears 164 and the planet gear carrier 168, the pinion gear 128 may be connected for rotation with the annulus 172 and the sun gear 160 is connected for rotation to the output shaft 156. In response to the motor torque exceeding the predetermined torque level, rotation of the sun gear 160 results in rotation of the planetary gear carrier 168 when the detents 120 move to the disengaged position. By way of another example, in an embodiment in which the detents 120 releasably retain the rotational position of the sun gear 160, the pinion gear 128 may be connected for rotation with the planetary gear carrier 168 and the annulus 172 may be connected for rotation with the output shaft 156. In response to the motor torque exceeding the predetermined torque level, rotation of the annulus 172 results in rotation of the sun gear 160 when the detents 120 move to the disengaged position. In these alternative embodiments, the grooves 188 are formed in the component of the planetary gear assembly 116 that is releasably retained.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. A starter motor comprising:

a housing defining an interior space;

a planetary gear assembly at least partially positioned in the interior space and including a plurality of planetary gear components, the planetary gear components comprising a sun gear, an annulus, a plurality of planet gears, and a planetary gear carrier; and a plurality of detents configured to releasably retain a rotational position of a component of the planetary gear components relative to the housing, each of the detents including a biasing member and a bearing member, wherein the component of the planetary gear components defines a plurality of grooves;

wherein the biasing members bias the bearing members at least partially into the grooves when a component torque is less than a predetermined torque level; and wherein the rotational position of the component of the planetary gear components remains stationary relative to the housing when the component torque is less than the predetermined torque level.

2. The starter motor of claim 1, wherein the bearing members are displaced from the grooves when the component torque is greater than or equal to the predetermined torque level.

3. The starter motor of claim 1, wherein the component of the planetary gear components is the annulus.

4. The starter motor of claim 1, wherein:

the sun gear defines an axis of rotation, and each of the detents is positioned a fixed distance from the axis of rotation.

5. A starter motor comprising:

a housing defining an interior space;

a planetary gear assembly at least partially positioned in the interior space and including a plurality of planetary gear components, the planetary gear components comprising a sun gear, an annulus, a plurality of planet gears, and a planetary gear carrier; and a plurality of detents configured to releasably retain a rotational position of a component of the planetary gear components relative to the housing, each of the detents including a biasing member and a bearing member, wherein the bearing member of each of the detents is a bearing ball.

6. The starter motor of claim 5, wherein:

the sun gear defines an axis of rotation, and each of the detents is positioned a fixed distance from the axis of rotation.

7. The starter motor of claim 5, wherein the component of the planetary gear components defines a plurality of grooves;

wherein the biasing members bias the bearing members at least partially into the grooves when a component torque is less than a predetermined torque level; and wherein the rotational position of the component of the planetary gear components remains stationary relative to the housing when the component torque is less than the predetermined torque level.

8. The starter motor of claim 5, wherein the component of the planetary gear components is the annulus.

9. A starter motor comprising:

a housing defining an interior space;

a planetary gear assembly at least partially positioned in the interior space and including a plurality of planetary gear components, the planetary gear components comprising a sun gear, an annulus, a plurality of planet gears, and a planetary gear carrier; and a plurality of detents configured to releasably retain a rotational position of a component of the planetary gear components relative to the housing, each of the detents including a biasing member and a bearing member, wherein:

the housing defines a plurality of bores, and the bearing member of each of the detents is positioned in a respective one of the bores.

10. The starter motor of claim 9, wherein the bearing member of each of the detents is a bearing ball.

11. The starter motor of claim 9, wherein the component of the planetary gear components is the annulus.

12. A starter motor comprising:

a housing defining an interior space; and a planetary gear assembly at least partially positioned in the interior space, the planetary gear assembly including a plurality of planetary gear components including an annulus, a sun gear, a plurality of planet gears, and a planet gear carrier, the annulus defining a plurality of grooves, wherein the annulus is configured to remain stationary relative to the housing when a component torque is less than a predetermined torque level, and a plurality of detents configured to releasably retain a rotational position of the annulus relative to the housing, each of the detents including a biasing member and a bearing member, wherein the annulus is configured to rotate relative to the housing when the component torque is greater than or equal to the predetermined torque level; and wherein the biasing members bias the bearing members at least partially into the grooves when the component torque is less than the predetermined torque level, and the bearing members are displaced from the grooves when the component torque is greater than or equal to the predetermined torque level.

13. The starter motor of claim 12, wherein the bearing member is a bearing ball.

14. The starter motor of claim 12, wherein:

the sun gear defines an axis of rotation, and each of the detents is positioned a fixed distance from the axis of rotation.

15. A starter motor comprising:

a housing defining an interior space and a plurality of bores;

a planetary gear assembly at least partially positioned in the interior space and including a sun gear, an annulus defining a plurality of grooves, and a plurality of planet gears;

a plurality of biasing members, each of the biasing member at least partially positioned in a respective one of the bores; and a plurality of bearing balls movable between a first position and a second position, each of the bearing balls biased toward the annulus by a respective one of the biasing members, wherein in the first position the biasing members bias each of the bearing balls at least partially into a respective one of the grooves to prevent rotation of the annulus relative to the housing, and wherein in the second position the plurality of bearing balls are displaced from the plurality of grooves to enable rotation of the annulus relative to the housing.

16. The starter motor of claim 15, wherein:

the bearing balls are in the first position when an annulus torque is less than a predetermined torque level, and the bearing balls are in the second position when the annulus torque is greater than or equal to the predetermined torque level.

17. The starter motor of claim 15, wherein:

the sun gear defines an axis of rotation, and each of the bearing balls are positioned a fixed distance from the axis of rotation.

18. The starter motor of claim 17, wherein the bearing balls move in a direction parallel to the axis of rotation when moving between the first position and the second position.

19. The starter motor of claim 18, wherein the plurality of biasing members is a plurality of compression springs.

20. The starter motor of claim 15 further comprising a bore structure provided on to the housing and defining the plurality of bores.

* * * * *